US009397394B2

(12) United States Patent
Cheng et al.

(10) Patent No.: US 9,397,394 B2
(45) Date of Patent: Jul. 19, 2016

(54) ANTENNA ARRAYS WITH MODIFIED YAGI ANTENNA UNITS

(71) Applicant: Commsky Technologies, Inc., Santa Clara, CA (US)

(72) Inventors: Po-shin Cheng, Femont, CA (US); Xin Li, HangZhou (CN); Daniel Wang, San Jose, CA (US); George Zhao, Palo Alto, CA (US); Jun Shen, Palo Alto, CA (US)

(73) Assignee: Commsky Technologies, Inc., Santa Clara, CA (US)

( * ) Notice: Subject to any disclaimer, the term of this patent is extended or adjusted under 35 U.S.C. 154(b) by 74 days.

(21) Appl. No.: 14/556,203

(22) Filed: Nov. 30, 2014

(65) Prior Publication Data

US 2015/0325924 A1 Nov. 12, 2015

Related U.S. Application Data

(63) Continuation-in-part of application No. 14/270,362, filed on May 6, 2014.

(51) Int. Cl.

| | |
|---|---|
| ***H01Q 3/24*** | (2006.01) |
| ***H01Q 19/185*** | (2006.01) |
| ***H01Q 21/28*** | (2006.01) |
| ***H01Q 1/38*** | (2006.01) |
| ***H01Q 19/10*** | (2006.01) |
| ***H01Q 19/30*** | (2006.01) |
| ***H01Q 21/20*** | (2006.01) |
| ***H01Q 21/24*** | (2006.01) |

(52) U.S. Cl.
CPC . *H01Q 3/24* (2013.01); *H01Q 1/38* (2013.01); *H01Q 19/108* (2013.01); *H01Q 19/185* (2013.01); *H01Q 19/30* (2013.01); *H01Q 21/20* (2013.01); *H01Q 21/24* (2013.01); *H01Q 21/28* (2013.01)

(58) Field of Classification Search
CPC ... H01Q 19/30; H01Q 19/108; H01Q 19/185; H01Q 21/20; H01Q 21/24; H01Q 21/28
See application file for complete search history.

(56) References Cited

U.S. PATENT DOCUMENTS 7,477,204 B2 * 1/2009 Lin ..... H01Q 3/242 343/795
9,116,239 B1 * 8/2015 Billsberry ..... G01S 13/882

* cited by examiner

*Primary Examiner* — Hoang V Nguyen
(74) *Attorney, Agent, or Firm* — Joe Zheng

(57) ABSTRACT

Techniques of designing an antenna array with antenna units controlled electronically are described. Each of the antenna units includes a reflector, a driven element and one or more directors. A substrate with conductive material on its surface provided to support the antenna array is designed to be the reflector. The driven element is separated into two halves with each on one side of a non-metal substrate vertically bonded to the conductive substrate. Two driving lines provided to drive the two halves of the driven element are disposed on both sides of the non-metal substrate to minimize possible interactions with other elements of the antenna unit or the antenna array.

17 Claims, 8 Drawing Sheets

Normalized Azimuth Pattern - Vertically Polarized
in dB

Normalized Elevation Pattern - Horizontally Polarized
in dB

ANTENNA ARRAYS WITH MODIFIED YAGI ANTENNA UNITS

CROSS REFERENCE TO RELATED APPLICATIONS

This is a continuation-in-part of co-pending U.S. application Ser. No. 14/270,362, entitled "Switchable antennas for wireless applications", filed May 6, 2014.

BACKGROUND OF THE INVENTION

1. Field of Invention

The invention generally is related to the area of antennas, and more particularly related to integrated antenna arrays structured in a way and controlled electronically to form a desired antenna pattern adapting to an environment, and providing reliable and efficient links between two transceivers.

2. Related Art

An antenna system is an indispensable component in communication systems. In conventional wireless communications, a single antenna is used at the source, and another single antenna is used at the destination. This is called SISO (single input, single output). Such systems are vulnerable to problems caused by multipath effects. When an electromagnetic field (EM field) is met with obstructions such as hills, canyons, buildings, and utility wires, the wavefronts are scattered, and thus they take many paths to reach the destination. The late arrival of scattered portions of the signal causes problems such as fading, cut-out (cliff effect), and intermittent reception (picket fencing). In a digital communications system like the Internet, it can cause a reduction in data speed and an increase in the number of errors.

The use of smart antennas can reduce or eliminate the trouble caused by multipath wave propagation from reflection, deflection, refraction, and scattering. A smart antenna is a digital wireless communications antenna system that takes advantage of diversity effect at the source (transmitter), the destination (receiver), or both. Diversity effect involves the transmission and/or reception of multiple radio frequency (RF) waves to increase data speed and reduce the error rate. Smart antennas (also known as adaptive array antennas, multiple antennas and, recently, MIMO) are antenna arrays with smart signal processing algorithms used to identify spatial signal signature such as the direction of arrival (DOA) of the signal, and use it to calculate beamforming vectors, to track and locate the antenna beam on a mobile target.

Most of the smart antennas in use today have some undesired nulls in the antenna patterns. In radio electronics, a null is an area or vector in an antenna radiation pattern where the signal cancels out almost entirely. If not carefully planned, nulls can unintentionally prevent reception of a signal and fail to transmit a signal. There is a need for an antenna system that has a controllable antenna pattern without developing nulls.

In general, an antenna array or system includes a number of antenna units that may be structured or controlled in different ways to achieve desired antenna radiation patterns. The antenna units are driven and operate independently. When the antenna units are integrated based on a substrate, additional designs are needed to minimize interactions among the antenna units and their feeding units when metal materials (e.g., driving lines) have to reach each of the antenna units.

This instant application discloses an antenna structure that utilizes a ground plane as part of the antenna structure to minimize, if not completely eliminate, possible interactions among antenna elements thereof and its feeding system.

SUMMARY OF THE INVENTION

This section is for the purpose of summarizing some aspects of the present invention and to briefly introduce some preferred embodiments. Simplifications or omissions in this section as well as in the abstract may be made to avoid obscuring the purpose of this section and the abstract. Such simplifications or omissions are not intended to limit the scope of the present invention.

The present invention generally pertains to designs of antenna arrays with antenna units controlled electronically to form a desired antenna pattern adapting to the environment, and providing reliable and efficient links between two transceivers. According to one aspect of the present invention, one of the two transceivers is a Wi-Fi Access Point (AP) device and the other one of the two transceivers is a client device (e.g., a computing device or a mobile phone). The antenna units in an antenna array of the Wi-Fi AP device are electronically controlled to provide the most reliable links with each and every client device it is being connected to.

According to another aspect of the present invention, there are at least one integrated antenna unit in an antenna array. The integrated antenna unit includes two pairs of antenna units that may be driven simultaneously or selectively by a source to achieve a desired coverage. Each of the antenna units includes a reflector, a driven element and one or more directors. A substrate with conductive material on its surface provided to support the antenna array is designed to be the reflector. The driven element is separated into two halves with each on one side of a non-metal substrate (e.g., printed circuit board or PCB) vertically bonded to the conductive substrate.

According to still another aspect of the present invention, two driving lines provided to drive the two halves of the driven element are disposed on both sides of the non-metal substrate to minimize possible interactions with other elements of the antenna unit or the antenna array.

According to yet another aspect of the present invention, a double-sided PCB is used to form the driven element and the directors. The PCB is mounted vertically to the conductive substrate.

Depending on the status (e.g., on or off), the radiation pattern of the antenna array is controlled electronically to provide the most reliable links with each and every client device it is being connected to. In principle, if there are n sets of antenna units in an antenna array, and each of the n sets of antenna units works independently, there are $2^n$ different radiation characteristics available to choose from.

Depending on implementation, the present invention may be implemented as a method, an apparatus or part of a system. According to one embodiment, the present invention is an antenna system that comprises: a flat metal substrate; a plurality of integrated antenna units, each of the integrated antenna units including four antenna elements, each of the antenna elements including: a piece of the flat metal substrate configured as a reflector; and a plate vertically bonded to the substrate, wherein the plate includes a driven element and at least one director, wherein the four antenna elements are vertically bonded to the flat metal substrate and jointly form an opening box.

According to another embodiment, the present invention is an antenna system that comprises an enclosure, a flat metal substrate supported in the enclosure and configured as a reflector, a plate vertically bonded to the metal substrate, wherein the plate includes a driven element and at least one director so that the reflector, the driven element and the director forms a Yagi antenna.

One of the objects, features and advantages of the present invention is to provide a smart antenna that is amenable to small footprint, broad operating wavelength range, enhanced antenna pattern, lower cost, and easier manufacturing process. Other objects, features, benefits and advantages, together with the foregoing, are attained in the exercise of the invention in the following description and resulting in the embodiment illustrated in the accompanying drawings.

BRIEF DESCRIPTION OF THE FIGURES

These and other features, aspects, and advantages of the present invention will be better understood with regard to the following description, appended claims, and accompanying drawings where:

DETAILED DESCRIPTION OF THE INVENTION

Figure 1:
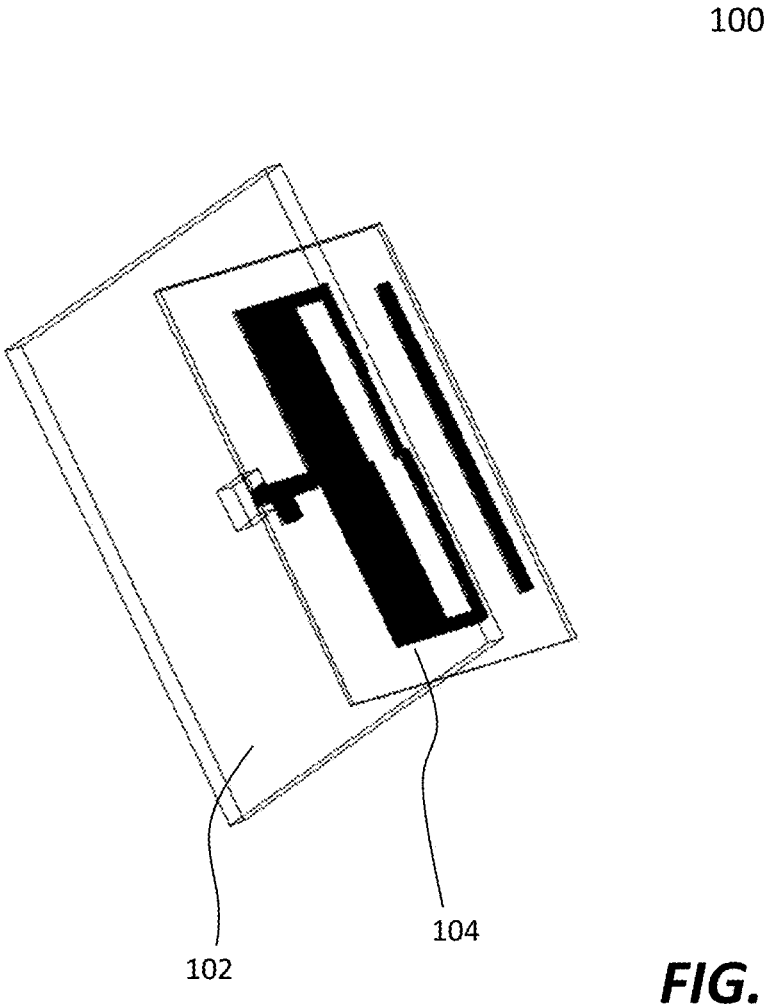
FIG. 1 shows a 3D perspective view of an antenna unit 100 according to one embodiment.

The detailed description of the invention is presented largely in terms of procedures, steps, logic blocks, processing, and other symbolic representations that directly or indirectly resemble the operations of communication devices coupled to networks. These process descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention. Unless specifically stated otherwise, whenever an application or a module is described herein to be configured to perform one or more tasks or achieve one or more objectives in the present invention, it means the application or a module is objectively designed, implemented, constructed, or architected for such.

Service providers are always looking for antenna systems that provide high power gain with small physical size. Further, it is desirable to deploy an antenna system that is capable of delivering optimal radio frequency (RF) power covering a known span of azimuthal angles. One embodiment of the present invention provides a new design to lead a feeding line (e.g., a metal line) to a proper antenna element with minimum impact on the resultant radiation pattern.

One type of antenna that may be used for an antenna system is Yagi antenna. It is a directional antenna consisting of multiple parallel dipole elements (reflectors and directors) in a line, usually made of metal rods. There is a single driven element connected to a driving source (a transmitter or a receiver) by a transmission line. The unique design achieves a very substantial increase in the directionality and gain of the antenna compared to a simple dipole.

To feed this type of antenna, a feeding line (e.g., a 50-ohm coaxial cable) has to find a way to reach the driven element located in between the directors and the reflector. In other words, the feed line has a good chance to interact with the antenna structure and change the antenna performance, which is undesirable and difficult to analyze and control. On the other hand, for the Wi-Fi applications, the antenna is often integrated with other electronics which require a substrate (e.g., a ground plane) for the system to work properly. One of the embodiments in the present invention is to utilize the substrate as part of the antenna structure and completely eliminates the interaction between the antenna elements and its feeding source system.

Referring now to the drawings, in which like numerals refer to like parts throughout the several views. According to one embodiment, FIG. 1 shows a 3D perspective view of an antenna unit 100 that has a substantially similar structure as a Yagi antenna does. A substrate 102 is designed to be a reflector of the antenna unit 100. In one embodiment, the substrate 102 is a metal sheet. In another embodiment, the substrate 102 has a conductive surface (e.g., strips). The substrate 102 is referred to as a metal substrate herein. A supporting plate 104 is vertically connected to the metal substrate 102. In one embodiment, the supporting plate 104 is a printed circuit board (PCB) on which a driven element and one or more directors are disposed or formed thereon. As further detailed in FIGS. 2A and 2B that show respectively each side of the antenna unit 100, a driven element is on both sides of the PCB 104. In other words, each side of the PCB 104 includes one half of the driven element 106 or 107 and a director 108 or 109, where the two halves 106 are 107 connected via a via. Depending on implementation, the via may be disposed between the two halves 106 are 107 or along a central line of the antenna unit. It should be noted that more directors may be added on each or one side of the antenna unit 100. In one embodiment, there is only one director on one selected side of the antenna unit 100.

Figure 2A:
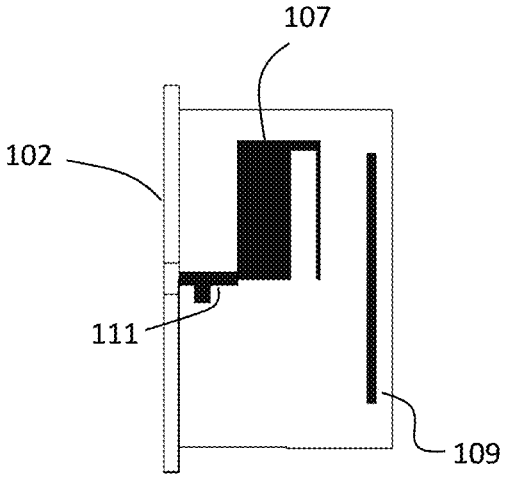
FIGS. 2A and 2B show respectively each side of the antenna unit of FIG. 1, where a driven element is decomposed into two halves and disposed respectively on both sides of a printed circuit board (PCB)
Figure 2B:
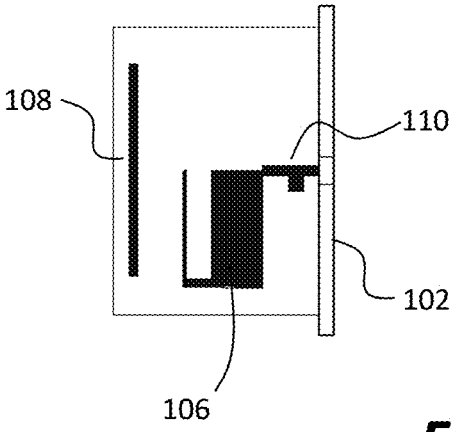

According to one embodiment, each of the two halves 106 or 107 of the driven element is connected to a driving source (not shown) via a metal strip 110 or 111 as a driving line. To match the impedance, the shape of the driving line is uniquely designed to be non-straight strip. In one embodiment, the shape of the driving line presents a non-symmetric T shape, as shown in FIGS. 2A and 2B, with a raised portion towards the reflector 102.

In one embodiment, the driving line 110 or 111 is disposed at the center of the antenna unit (not necessarily the center of the PCB). As there are two driving lines, each for one side, these two driving lines 110 and 111 are disposed back to back on the PCB. As described above, the driving element is separated into two halves 106 or 107. In one embodiment, the two halves 106 or 107 are identical in shape. As shown in FIGS. 2A and 2B, the shape appears rectangular with a parallel conductor strip spaced apart to meet the impedance requirement, where the conductor strip is conductively coupled to the rectangular shape of the half driven element 106 or 107. It should be noted that there can be other designs or shapes of the driven element. Because of its centralized location and a certain width of the metal strip, the driving line 110 or 111 shall appear going beyond the boundary of its half driven element 106 or 107.

Among others, the differences between this new design of FIG. 1 and a typical Yagi antenna are at least two folds. The first is that the reflector as a single element is eliminated and replaced by a ground plane which can be part of the Wi-Fi circuitry. The second is that a unbalanced coaxial feed system is terminated at the ground plane and is shielded from the driven dipole by the ground plane.

Figure 3A:
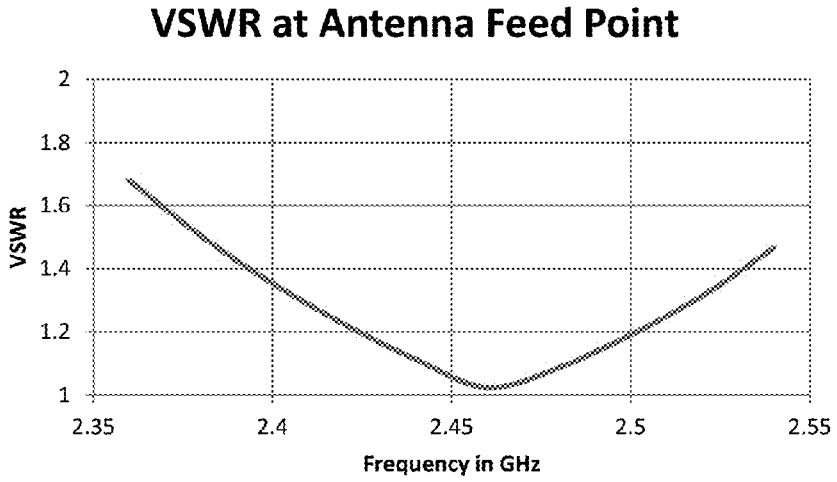
FIG. 3A shows the VSWR in the 2G WiFi band.
Figure 3B:
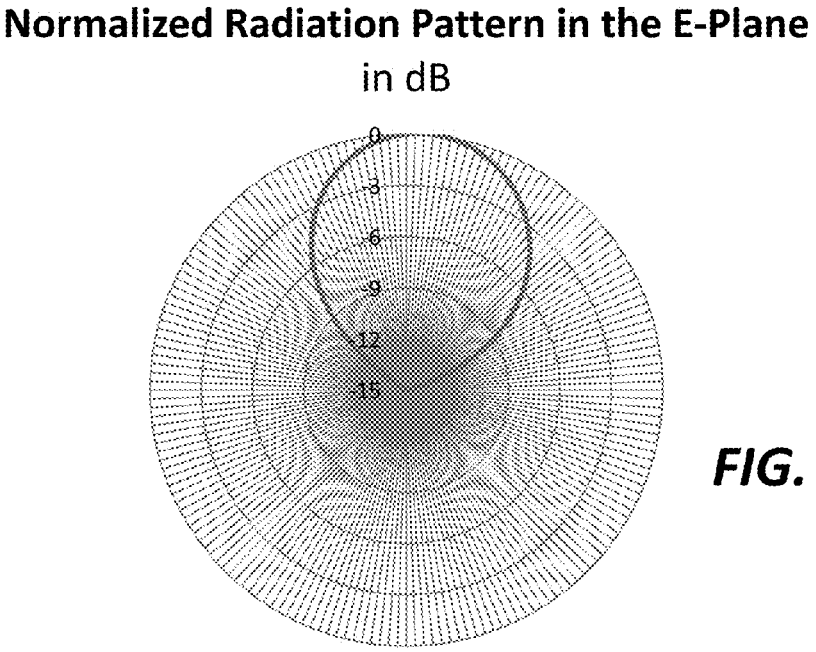
FIG. 3B shows the radiation pattern in the E-plane.
Figure 3C:
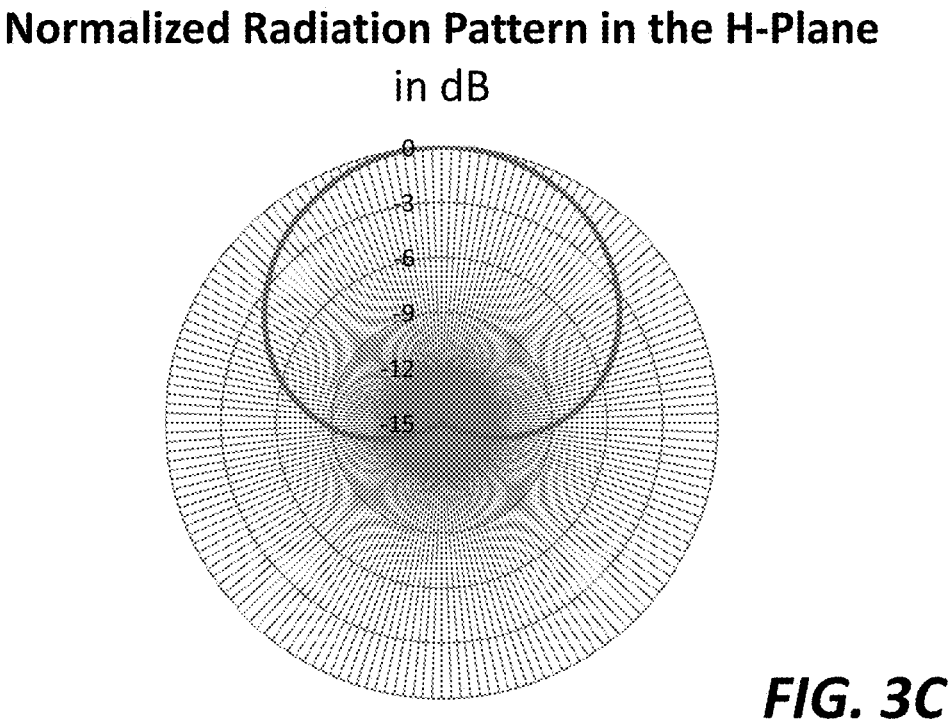
FIG. 3C shows the radiation pattern in the H-Plane.

For completeness, FIG. 3A shows the VSWR in the 2G WiFi band, where VSWR stands for voltage standing wave ratio and is a function of the reflection coefficient describing the power reflected from the antenna. FIG. 3B shows the radiation pattern in the E-plane, and FIG. 3C shows the radiation pattern in the H-Plane. For a linearly-polarized antenna, the electric field or E-plane is the plane containing the electric field vector and the direction of maximum radiation, determining the polarization or orientation of the radio wave. For a vertically polarized antenna, the E-plane usually coincides with the vertical/elevation plane. For a horizontally polarized antenna, the E-Plane usually coincides with the horizontal/azimuth plane. E-plane and H-plane should be 90 degrees apart.

Figure 4A:
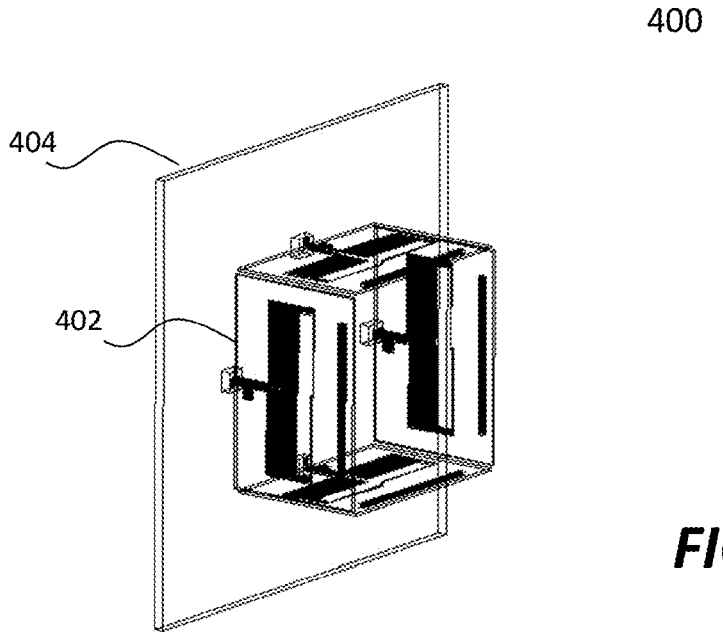
FIG. 4A shows a 3D perspective view of an antenna array or system antenna employing four antenna units, one example of the antenna units corresponds to the antenna of FIG. 1.
Figure 4B:
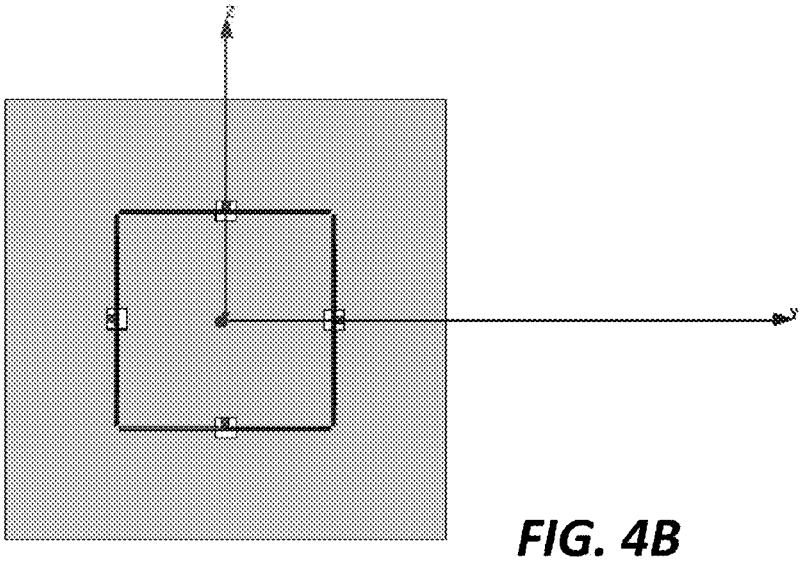
FIG. 4B shows a top view of the integrated antenna units of FIG. 4A.

Referring now to FIG. 4A, it shows a 3D perspective view of an antenna array or system antenna 400 employing a plurality of antenna units 402. As shown in FIG. 4A, there are four identical antenna units 402 vertically bonded to a substrate 404. As discussed above, the substrate 404 is designed to function as a reflector for each of the four identical antenna units 402. As shown in FIG. 4A, the four identical antenna units 402 are integrated to form an open box. A top view of the integrated antenna units is shown in FIG. 4B.

FIG. 4A shows an embodiment of the present invention, in which each of the antenna units 402 correspond to the one shown in FIG. 1A. Each of the antenna units 402 is on a PCB, where the PCBs in FIG. 4A are intentionally shown with some degrees of transparency so that the copper traces on both sides of the PCBS may be seen. Each pair of the antenna units 402 include two opposite antennas units, and are excited in parallel and in phase simultaneously. In other words, two independent RF channels can be supported by this compact antenna array structure. One RF channel uses a pair of the two antenna units that are oriented horizontally, and the other RF channel uses another pair of two antenna units that are oriented vertically. It is well known in the RF community that the orientations of a dipole uniquely define the polarization of the RF energy radiated from the dipole. Therefore, using this compact antenna array configured in the orientation depicted in FIG. 4A, one RF channel will provide vertically polarized RF radiation and the other RF channel will provide horizontally polarized RF radiation. The polarization diversity is known to be important in improving Wi-Fi coverage and services.

Figure 5A:
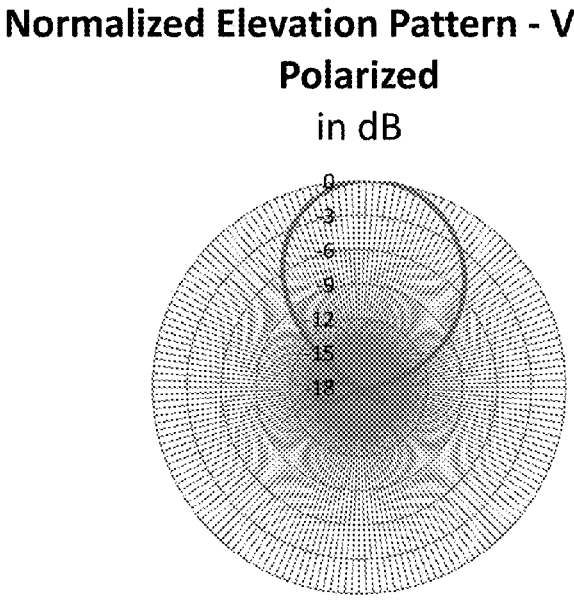
FIG. 5A shows the elevation pattern of the vertically polarized mode.
Figure 5B:
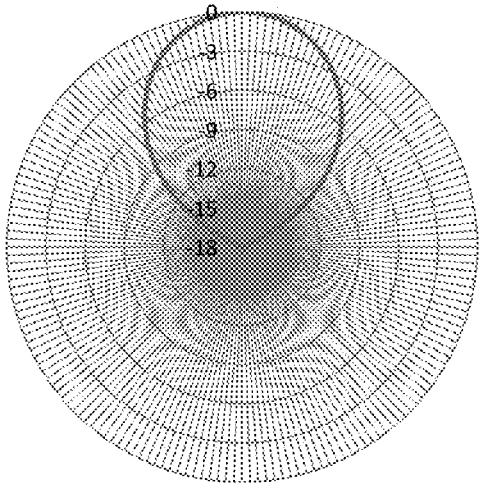
FIG. 5B shows the azimuth pattern of the same vertically polarized mode.
Figure 6A:
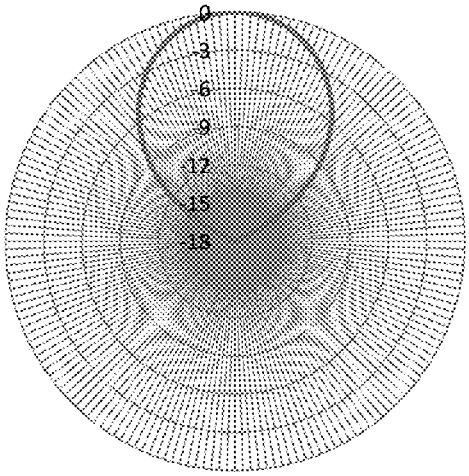
FIG. 6A shows the elevation pattern of the horizontally polarized mode.
Figure 6B:
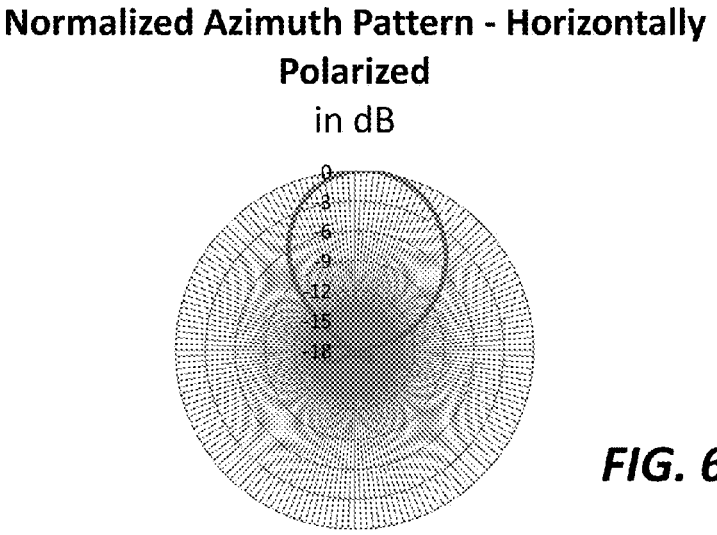
FIG. 6B shows the azimuth pattern of the same horizontally polarized mode.

For completeness, FIG. 5A shows the elevation pattern of the vertically polarized mode and FIG. 5B shows the azimuth pattern of the same vertically polarized mode. FIG. 6A shows the elevation pattern of the horizontally polarized mode and FIG. 6B shows the azimuth pattern of the same horizontally polarized mode. It may be noticed that FIG. 5A and FIG. 6A are nearly identical; and FIG. 5B and FIG. 6B are nearly identical. This is one of the features uniquely provided by the design of this compact antenna array shown in FIG. 4A. It means that this antenna design allows two independent channels to provide two linearly independent RF polarizations covering identical physical space. This is extremely important in optimizing the Wi-Fi coverage and services.

Figure 7:
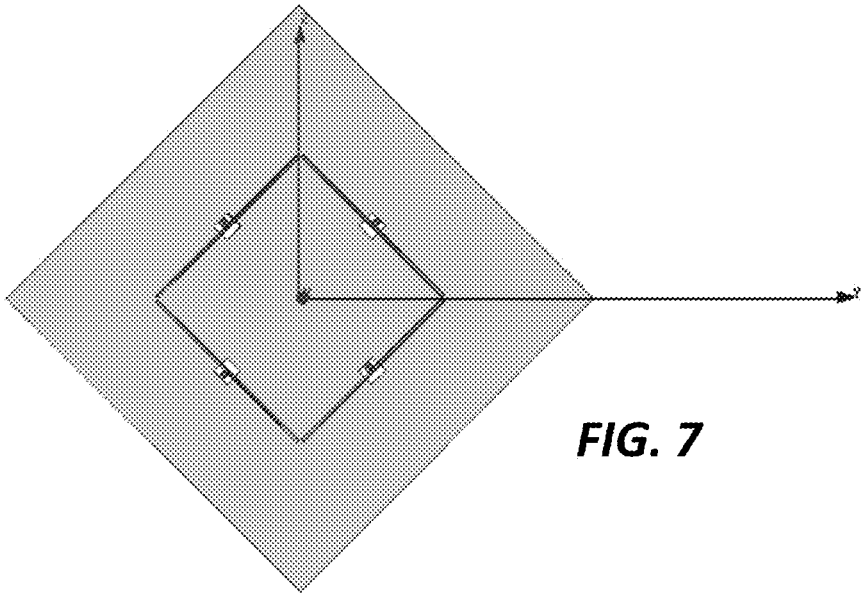
FIG. 7 shows an alternative orientation of the same compact antenna array of FIG. 4A, where the two independent RF polarizations are neither vertical nor horizontal.

FIG. 7 shows an alternative orientation of the same compact antenna array of FIG. 4A, where the two independent RF polarizations are neither vertical nor horizontal. Essentially, one is tilted by +45 degrees from being vertical and the other is tilted by −45 degrees from being vertical. Radiation characteristics of these two independent polarizations remain nearly identical.

According to another embodiment, the antenna system shown in FIG. 4A may be used as a building block and repeated along the same substrate to form a larger antenna array. Structurally, these antenna units (e.g., an example shown in FIG. 1) or the integrated units (e.g., an example shown in FIG. 4A) are arranged in such a way that the resultant antenna system is physically symmetric and has one RF source to drive all the antenna units simultaneously or selectively.

Figure 8:
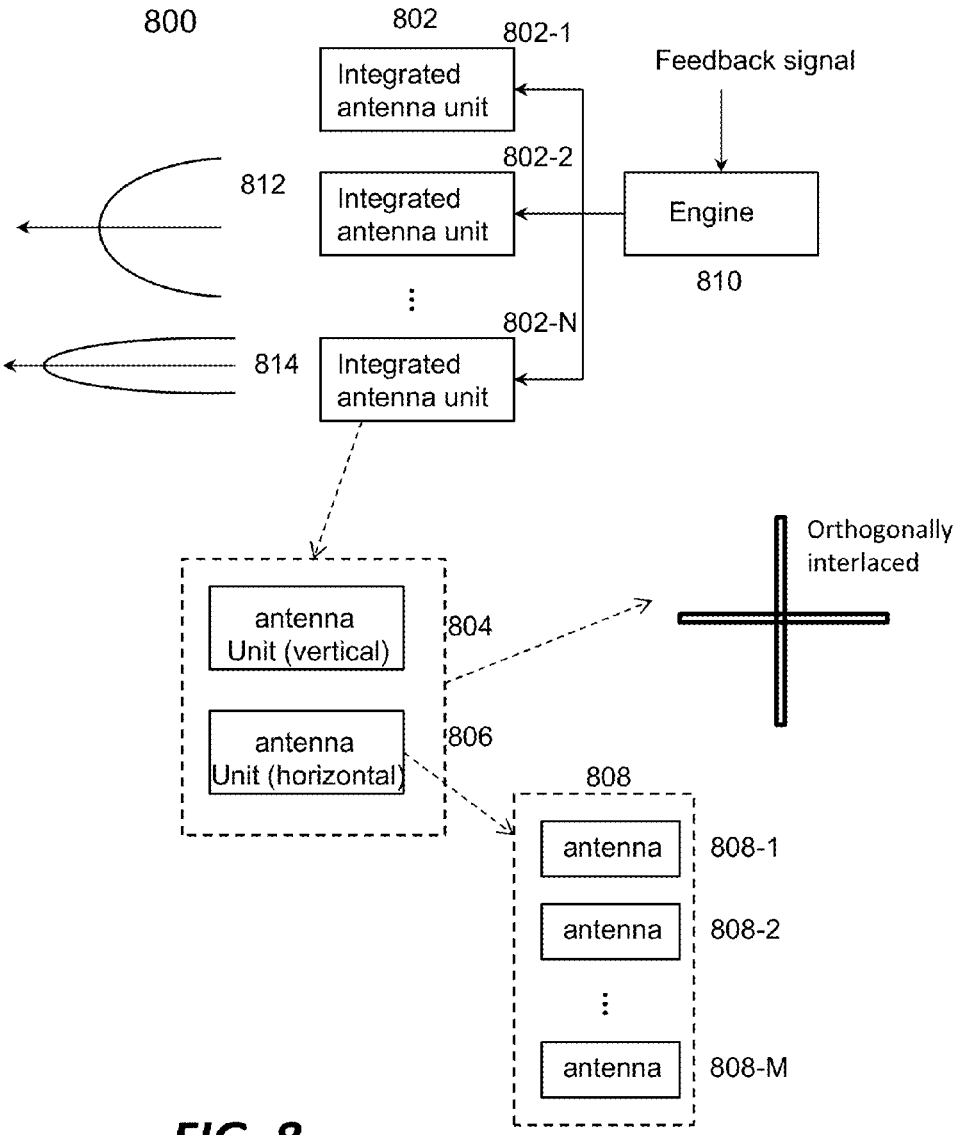
FIG. 8 shows a system block diagram of an antenna system according to one embodiment of the present invention.

Referring now to FIG. 8, it shows a system block diagram of an antenna system 800 according to one embodiment of the present invention. As shown in FIG. 8, the antenna system 800 is structured with or includes a plurality of integrated antenna units 400 of FIG. 4A, each of the integrated antennas units 802 includes four antenna units (e.g., corresponding to the antenna unit 100 of FIG. 1). Two opposite antenna units form a pair, thus there are a horizontally polarized antenna pair and a vertically polarized antenna pair. In general, the antenna system 800 is enclosed in an enclosure.

In operation, the antenna system 800 is energized by an engine 810. In transmitting mode, the engine 810 feeds a transmitting signal to the antenna system 800. In receiving mode, the engine 810 is configured to receive the signal from the antenna system 800. For better reception, in responding to a signal provided to the engine 810 the engine 810 is configured to dynamically change the antenna pattern by selectively driving one or more of the antennas 808, one or more of the antenna units 804 and 806, or one or more of the integrated antennas units 802.

In an exemplary application, an access point (e.g., a Wi-Fi device) is equipped with the antenna system 800 and is accessed by a mobile device. The default antenna pattern of the antenna system 800 (when all elements are energized) is no longer efficient. Ideally, the antenna pattern of the antenna system 800 shall be more directional towards the mobile device. Based on the RF signals exchanged between the two devices, the engine 810 can be figured to selectively energize one or more of the antenna units in the antenna system 800 to reshape the default antenna pattern to provide better Wi-Fi coverage.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim. Accordingly, the scope of the present invention is defined by the appended claims rather than the forgoing description of embodiments.

We claim:

1. An antenna system comprises:

a flat metal substrate;

a plurality of integrated antenna units, each of the integrated antenna units including four antenna elements, each of the antenna elements including:

a piece of the flat metal substrate configured as a reflector; and a plate vertically bonded to the substrate, wherein the plate includes a driven element and at least one director;

wherein the four antenna elements are vertically bonded to the flat metal substrate and jointly form an opening box.

2. The antenna system as recited in claim 1, wherein two opposite antenna elements in each of the integrated antenna units form one pair, another two opposite antenna elements in the each of the integrated antenna units form another pair, both pairs are excited in parallel and in phase simultaneously to create two independent RF channels.

3. The antenna system as recited in claim 2, wherein the two independent RF channels are oriented horizontally and vertically, respectively.

4. The antenna system as recited in claim 1, wherein the integrated antenna units are excited simultaneously or selectively.

5. The antenna system as recited in claim 1, wherein the plate is a printed circuit board (PCB), the driven element is formed by two halves respectively on both sides of the PCB, the two halves are connected via a via.

6. The antenna system as recited in claim 5, wherein each of the two halves is rectangular in shape with a strip in parallel.

7. The antenna system as recited in claim 6, wherein each of the two halves is coupled to a source by a driving line formed on the PCB.

8. The antenna system as recited in claim 7, wherein the driving line presents a non-symmetric T shape with a raised portion towards the reflector.

9. The antenna system as recited in claim 8, wherein both sides of the PCB includes the director.

10. The antenna system as recited in claim 8, wherein the director is on only one side of the PCB.

11. The antenna system as recited in claim 1, wherein the antenna system is enclosed in an enclosure.

12. An antenna system comprises:

an enclosure;

a flat metal substrate supported in the enclosure and configured as a reflector;

a plate vertically bonded to the metal substrate, wherein the plate includes a driven element and at least one director so that the reflector, the driven element and the director forms a Yagi antenna, wherein the plate is a printed circuit board (PCB), the driven element is formed by two halves respectively on both sides of the PCB.

13. The antenna system as recited in claim 12, wherein each of the two halves appears rectangular in shape with a strip in parallel.

14. The antenna system as recited in claim 13, wherein each of the two halves is coupled to a source by a driving line formed on the PCB.

15. The antenna system as recited in claim 14, wherein the driving line presents a non-symmetric T shape with a raised portion towards the reflector.

16. The antenna system as recited in claim 15 wherein both sides of the PCB includes the director.

17. The antenna system as recited in claim 15, wherein the director is on only one side of the PCB.

* * * * *